United States Patent [19]

Matsumoto et al.

[11] 3,933,024

[45] Jan. 20, 1976

[54] METHOD FOR COLD ROLLING OF A HIGH MAGNETIC FLUX DENSITY GRAIN-ORIENTED ELECTRICAL STEEL SHEET OR STRIP HAVING EXCELLENT PROPERTIES

[75] Inventors: Fumio Matsumoto; Katuro Kuroki; Kunihide Takashima; Toshihiko Takata; Hiromichi Yasumoto, all of Kitakyushu; Kuniyasu Honda, Nakama, all of Japan

[73] Assignee: Nippon Steel Corporation, Japan

[22] Filed: June 10, 1974

[21] Appl. No.: 478,100

[30] Foreign Application Priority Data

June 18, 1973 Japan ..... 48-68458

[52] U.S. Cl. ..... 72/364; 148/111; 148/113

[51] Int. Cl.[2] ..... B21B 3/02

[58] Field of Search ..... 148/110, 111, 112, 113; 72/364

[56] References Cited

UNITED STATES PATENTS

| | | | |
|---|---|---|---|
| 3,008,857 | 11/1961 | Mobius | 148/111 |
| 3,287,183 | 11/1966 | Taguchi | 148/111 |
| 3,843,422 | 10/1974 | Henke | 148/111 |

*Primary Examiner*—Lowell A. Larson
*Attorney, Agent, or Firm*—Toren, McGeady and Stanger

[57] ABSTRACT

A cold rolling method for producing a high magnetic flux density grain oriented electrical steel sheet or strip having remarkably excellent $B_8$ characteristics, comprising subjecting a hot rolled steel sheet or strip a combination of heavy cold rolling with annealing during which the steel sheet or strip is held at a temperature between 100° and 350°C at an interim sheet thickness stage during the heavy cold rolling.

1 Claim, 4 Drawing Figures

METHOD FOR COLD ROLLING OF A HIGH MAGNETIC FLUX DENSITY GRAIN-ORIENTED ELECTRICAL STEEL SHEET OR STRIP HAVING EXCELLENT PROPERTIES

BACKGROUND OF THE INVENTION

The present invention relates to a method for producing a grain-oriented electrical steel sheet or strip (hereinafter referred to as sheet) having the grain orientation {110}<001> which is easily magnetizable in the rolling direction.

The grain oriented electrical steel sheet is required to have a high magnetic flux density and low watt loss characteristic.

Recently, great importance has been put on the minimization of size as well as the improvement of performance of transformers, etc., and for this purpose it is necessary to reduce the weight of iron cores for such applications. In general, in order to reduce the iron core weight, the iron core must be used in a range of high magnetic flux density so that a material having good magnetization characteristics, namely a high $B_8$ (a magnetic flux density at a magnetizing force 800 AT/cm), must be used for the iron cores.

Meanwhile, when it is used at a high magnetic flux density, the watt loss will increase and in this case it is noticeable that the watt loss of a material having higher $B_8$ is far much smaller than that of a material having a lower $B_8$ in a high magnetic flux zone, and yet the increasing rate of the watt loss accompanying the increase of the magnetic flux density is lower in the case of the material having high $B_8$.

The present invention provides a method which can produce steel products satisfying the above requirements, namely a high magnetic flux density grain-oriented electrical steel sheet having remarkably excellent excitation characteristic, namely an excellent $B_8$ characteristic of more than 1.90 wb/m² as compared with a conventional grain-oriented electrical steel sheet.

PRIOR ART

As for the production of a high magnetic flux grain oriented electrical steel sheet, such steel sheet can be obtained from a steel containing a small amount of acid soluble aluminum (hereinafter referred to as aluminum) as disclosed in Japanese patent publications No. 33-4710, No. 40-15644 and No. 46-23820 for example, and the feature of these prior patents reside in that A/N is used and a strong reduction is effected in the final cold rolling step.

In the production of a grain-oriented electrical steel sheet, in general, it is possible to obtain a steel product having {110}<001> orientation, namely the so-called Goss texture, and an excellent magnetization characteristic in the rolling direction due to the secondary recrystallization phenomenon in the final annealing. In this case, precipitates produced by added elements, such as nitrides, sulfides and oxides play an important role.

It has been conventionally considered that these precipitates are finely dispersed in the matrix to inhibit the grain growth of the matrix and improve the secondary recrystallization but, as disclosed in the Japanese Pat. publication No. 46-23820, these precipitates are precipitated in a specific orientation in respect to the matrix, and thereby selectively promote only the grains of the specific orientation, so that the orientation of the secondary recrystallization grains is strictly controlled and a steel product having very excellent orientation, namely a good $B_8$ characteristic, can be obtained.

SUMMARY OF THE INVENTION

The present inventors have found that the cold rolling conditions of the above heavy reduction have important effects on the magnetic characteristics of the final steel product in case of the production of a high magnetic flux density grain oriented electrical steel sheet utilizing the effects of A/N.

More specifically, it has been discovered that when the steel sheet, in the course of the cold rolling, is held at a temperature between 100° and 350°C for more than one minute and then is again rolled into a final thickness and the combination of the cold rolling and the low-temperature heat treatment (hereinafter referred to as aging) is repeated until the final sheet thickness, a steel product having a better $B_8$ characteristic and lower watt loss, as compared with a conventional high magnetic flux density electrical steel sheet, can be obtained.

It is considered that the above improvement of properties are brought about by the fact that the solid solution nitrogen gathers at the defect portions of the steel sheet formed during the rolling when the aging is done in the course of the cold rolling and this gathering of nitrogen causes a change in the deformation mechanism during the subsequent rolling and thus varies the cold rolled texture of the final sheet thickness. Also, the solid solution nitrogen, which is uniformly dispersed in the matrix, prevents excessive coarsening of AlN during the subsequent annealing and contributes to formation of favourable fine AlN. These facts cause a change in the orientation of the primary recrystallization grains and the growth of the specific secondary recrystallization grains is promoted by the favorable fine AlN.

DETAILED DESCRIPTION OF THE INVENTION

The steel composition to which the present invention is applied must satisfy the following conditions which are required for a high magnetic flux density electrical steel sheet.

Si : 2.5 to 4.0 percent

C : 0.085 percent maximum

Al(acid soluble): 0.010 to 0.065 percent

Silicon contents of more than 4 percent are not desirable because they cause difficulties in the cold rolling, but on the other hand, silicon contents below 2.5 percent bring about the disadvantages of lowered electric resistance and increased watt loss.

Carbon must be present, depending on the silicon content, in an amount sufficient to cause tranformation in at least in part of the steel. When the carbon content exceeds 0.085 percent, not only it is impossible to obtain a high magnetic flux density steel sheet, but also it is difficult to accomplish complete decarburization.

Aluminum is a basic element for assuring a high magnetic flux density steel sheet in the present invention, and aluminum contents outside the above range render the secondary recrystallization unstable, and thus a high magnetic flux density steel sheet cannot be obtained.

Other than the above basic elements, elements such as sulfur may be contained so far as they do not deviate from the objects of the present invention or adversely affect the steel.

Nitrogen is normally contained in an amount more than 0.0020 percent in ordinary commercial steel, and this level of nitrogen content is enough for forming AlN in the present invention.

Any steel ingot or slab which is prepared by conventional steel making, melting and ingot or slab making practice may be used in the present invention.

The steel ingot or slab is first hot rolled into a hot rolled steel coil.

According to the present invention, the cold rolling is done by one step, and a heavy reduction of 81 to 95 percent is required to obtain a high magnetic flux density grainoriented electrical steel sheet.

Prior to this heavy reduction cold rolling, AlN precipitation annealing is effected by heating the steel at a temperature between 950° and 1200°C for 30 seconds to 30 minutes and rapidly cooling the steel from a temperature range from 750° to 950°C down to 400°C in a time from 2 to 200 seconds.

If the annealing temperature, time and the cooling conditions are outside the above respective range, the secondary recrystallization become unstable, and high magnetic flux density can not be obtained.

The most important feature of the present invention lies in the above heavy reduction cold rolling step. This heavy reduction cold rolling may be done by any conventional cold rolling mill, but the cold rolling method is critical in the present invention.

Thus, in order to attain the heavy cold rolling of 81 to 95 percent reduction by one step, the final sheet thickness is obtained normally by plural passes of rolling through various interim sheet thicknesses. During this rolling step, the coil must be held at a temperature between 100° and 350°C for 1 minute or more to effect the aging treatment.

In this cold rolling method, when the combination of the rolling and the aging is repeated as shown here under, the magnetic properties of the steel product are further improved. Hot Rolling - Rolling - Aging - Rolling - Aging . . . Rolling (starting thickness) (final thickness)

Strong Reduction Rolling (81 to 95%)

If the aging treatment conditions are outside the above temperature and time ranges, not only can no improvement of the product properties be expected, but they tend to deteriorate the product properties.

In the conventional cold rolling method, the rolls are cooled by applying coolant thereon in order to prevent the burning of the steel sheet and to give lubricity. Therefore, the conventional cold rolling method does not suggest the technical thought and thermal effects of the intermediate aging between 100° and 350°C in the present invention. The thermal effects in the present invention can be attained by appropriately controlling the amount of the coolant during the cold rolling, for example by reducing the coolant nozzle, or may be attained by providing a heat retaining or heating device in the course of the cold rolling step to give the thermal effects to the steel sheet. It is possible to prevent the burning of the steel sheet and the rolls and shortness of lubricity and improve the magnetic properties of the steel sheet by controlling the supply of coolant depending on the type of cold rolling mill used.

As the upper limit of the aging is set at 350°C, the productivity is not lowered at all by the aging so that a great advantage can be obtained. Although some effect can be obtained by the aging even at 50°C, remarkable effect on improvement of the magnetic properties can be obtained when the aging is done at 100°C or higher.

In any event, it is necessary to provide enough temperature and time for causing aging of the steel coil.

Meanwhile no specific limitation is required during the cold rolling.

If the aging treatment is done prior to the beginning of the cold rolling, the magnetic properties of the product is poor, as explained hereinafter. Also if the aging treatment is done at the time of the final sheet thickness, no improvement of the properties is obtained.

Meanwhile, after the aging the steel coil may be cooled to an ordinary temperature and rolled, or may be rolled directly after the aging without cooling.

The steel coil which has been reduced to its final sheet thickness by the cold rolling is then subjected to decarburization annealing at a temperature between 700° and 900°C for 30 seconds to 30 minutes to lower the carbon content to 0.005 percent or less.

After the decarburization annealing, an annealing separator is applied to the surface of the steel sheet for prevention of burning of the steel sheet during a final finishing annealing.

The final finishing annealing should be done at a temperature and time coefficient to assure satisfactory development of the Goss orientation, namely the secondary recrystallization grains of {110}<001>.

For this purpose, it is necessary to anneal the steel at a temperature not lower than 1000°C for at least 5 hours in an $H_2$ or $N_2$ atmosphere.

PREFERRED EMBODIMENTS OF THE INVENTION

The present invention will be more clearly understood from the following descriptions of the examples of the present invention with reference to the attached drawings.

EXAMPLE 1

Steel material containing 0.04% C, 2.9% Si and 0.03% Al was hot rolled into a sheet thickness of 2.3 mm.

This hot rolled steel sheet coil was subjected to continuous annealing followed by rapid cooling and acid pickling, and cold rolled into a final sheet thickness of 0.30 mm under the following conditions.

| Starting Thickness (in mm) | Partway Thickness (in mm) | Aging* | Final Thickness (in mm) | Remarks |
|---|---|---|---|---|
| 2.3 | → | | 0.30 | (Conventional) |
| " | → | 200°C×5 hrs → | " | |
| " | 2.1 | " | " | |
| " | 2.0 | " | " | |
| " | 1.0 | " | " | |
| " | 0.40 | " | " | |
| " | 0.30(Final thickness) | " | — | |

*Aging was done by holding the steel at the indicated temperature for the indicated time.

Thus obtained cold rolled steel sheet was subjected to decarburization annealing at 850°C and then a final annealing at 1200°C to obtain final products.

Figure 1:
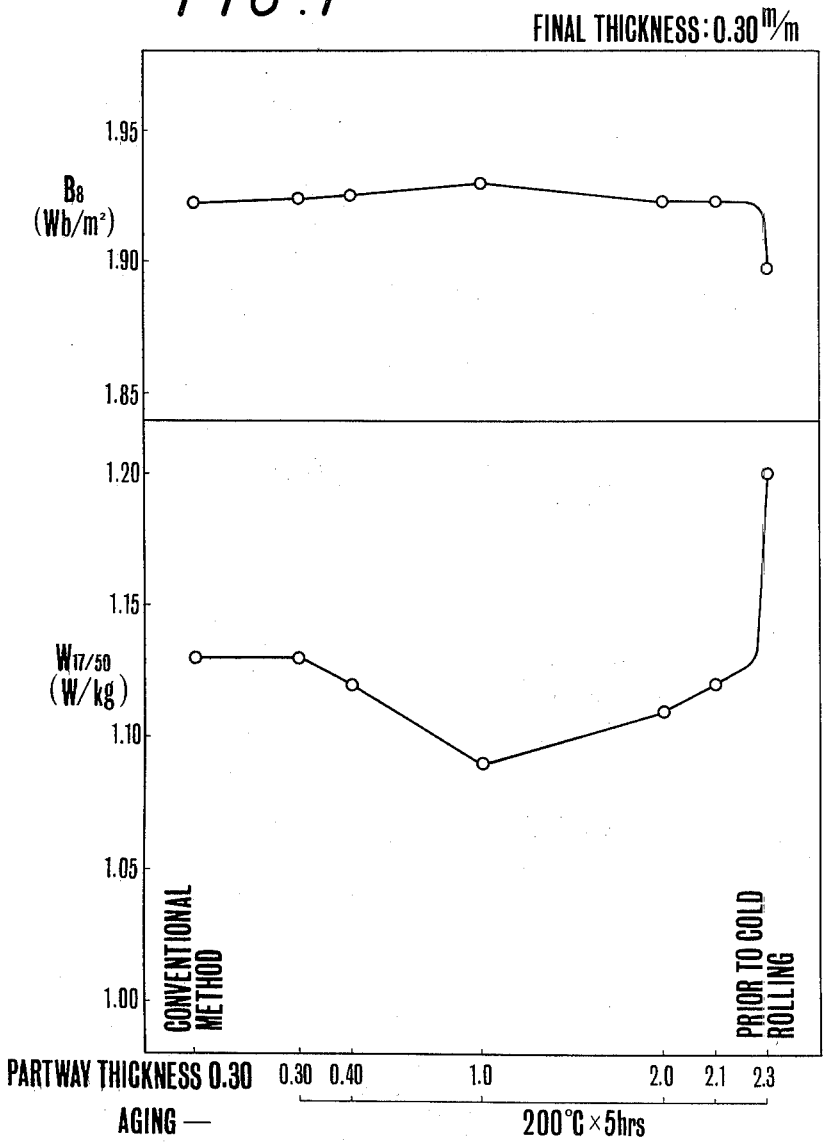
FIG. 1 is a graph showing the magnetic properties of the steel product obtained by Example 1.

The magnetic properties of the products thus obtained are shown in FIG. 1.

It is understood from FIG. 1, that the aging effects in the course of the cold rolling are remarkable, and it is also understood that the properties of the products are considerably deteriorated when the aging is done prior to the cold rolling, and that the aging treatment at the final sheet thickness stage does not contribute to improve the properties of the product at all.

EXAMPLE 2

The same steel material which was hot rolled, continuously annealed and acid pickled in the same way as in Example 1 was cold rolled to a final sheet thickness of 0.30 mm under the following conditions.

| Starting Thickness (in mm) | Partway Thickness (in mm) | Aging* | Final Thickness (in mm) | Remarks |
|---|---|---|---|---|
| 2.3 | → | | 0.30 | (Conventional) |
| " | 1.0 | 25°C×5 hrs. | " | |
| " | " | 50 " | " | |
| " | " | 100 " | " | |
| " | " | 150 " | " | |
| " | " | 200 " | " | |
| " | " | 250 " | " | |
| " | " | 300 " | " | |
| " | " | 350 " | " | |
| " | " | 400 " | " | |

*Aging was done by holding the steel at the indicated temperature for the indicated time.

Figure 2:
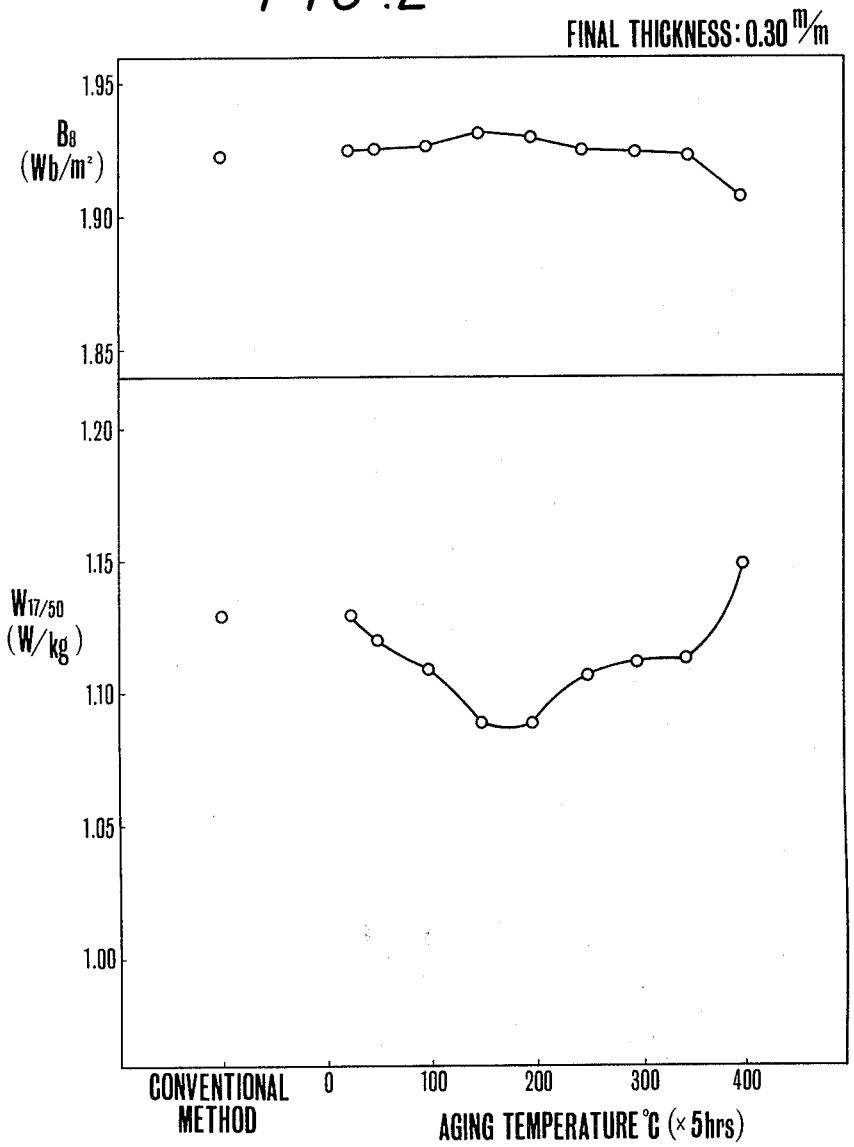
FIG. 2 is a graph showing the magnetic properties of the steel product obtained by Example 2.

The same decarburization annealing and final annealing as in Example 1 were done. The magnetic properties of the products are shown in FIG. 2.

The aging effects are observed when the aging at the interim sheet thickness is done at a temperature between 100° and 350°C. Meanwhile no effects is observed by the aging at the final sheet thickness.

EXAMPLE 3

The same steel material hot rolled, continuously annealed and acid pickled as in Example 1 was cold rolled to a final sheet thickness of 0.30 mm under the folliwng conditions.

| Starting Thickness (in mm) | Partway Thickness (in mm) | Aging* | Final Thickness (in mm) | Remarks |
|---|---|---|---|---|
| 2.3 | → | | 0.30 | (Conventional) |
| " | 1.0 | 150°C×0.5 min. | " | |
| " | " | 1 " | " | |
| " | " | 5 " | " | |
| " | " | 30 " | " | |
| " | " | 1 hr | " | |
| " | " | 5 " | " | |
| " | " | 24 " | " | |
| " | " | 48 " | " | |

*Aging was done by holding the steel at the indicated temperature for the indicated time.

Figure 3:
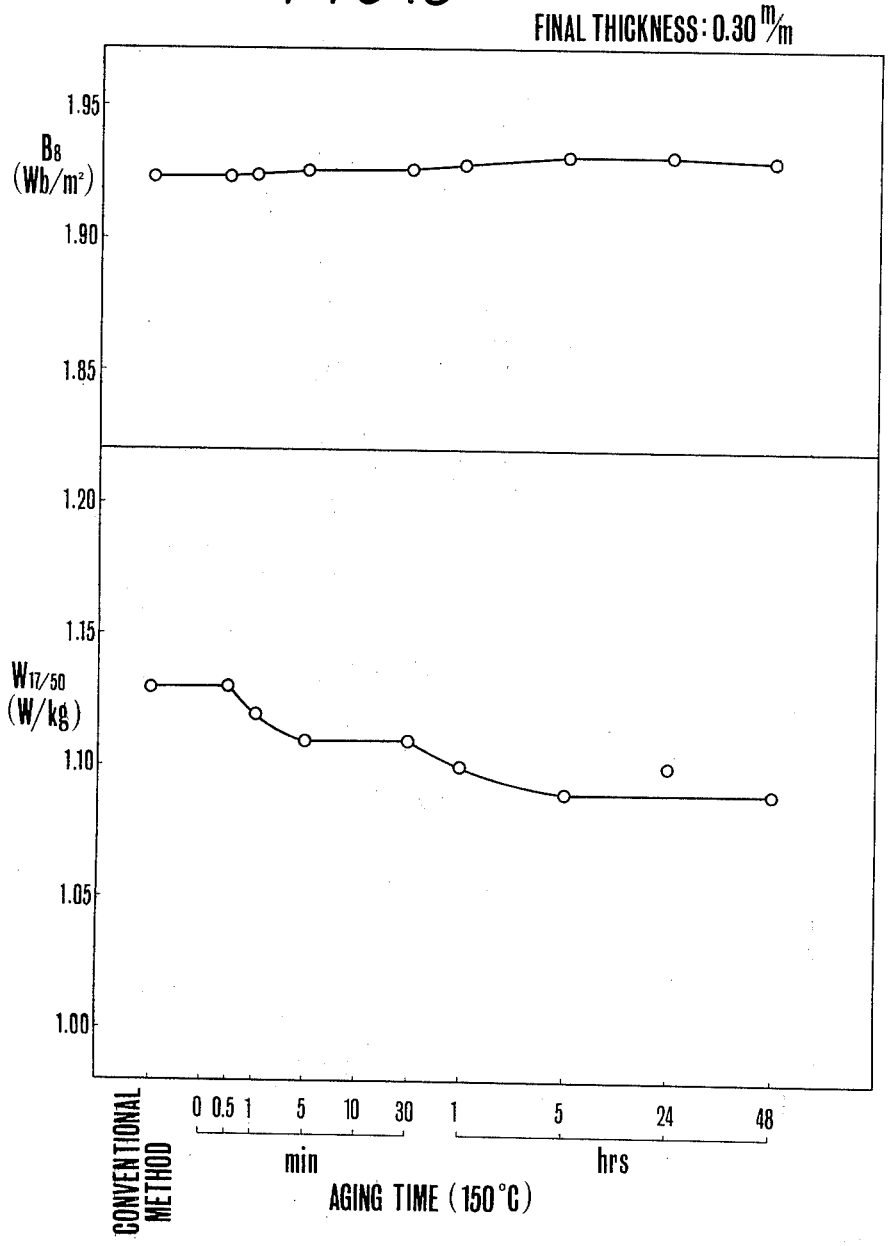
FIG. 3 is a graph showing the magnetic properties of the steel product obtained by Example 3.

The same decarburization and final annealing as in Example 1 were conducted. The magnetic properties of the products are shown in FIG. 3. The effects are observed when the aging is done for 1 minute or more.

EXAMPLE 4

The same steel material hot rolled, continuously annealed and acid pickled as in Example 1 was cold rolled to a final sheet thickness of 0.30 mm under the following conditions.

| Conditions | Starting Thickness (in mm) | Aging* | Final Thickness (in mm) | Remarks |
|---|---|---|---|---|
| A | 2.3 | → | 0.30 | (Conventional) |
| B | " | Partway thickness: | | |

-continued

| Conditions | Starting Thickness (in mm) | Aging* | Final Thickness (in mm) | Remarks |
|---|---|---|---|---|
| | | 1.0 mm;150°150°C×5 hrs. | " | <One time aging> |
| C | " | Per each cold rolling pass;150°C × 5 min. | | <Per each pass aging> |

*Aging was done by holding the steel at the indicated temperature for the indicated time.

The same decarburization and final annealing as in Example 1 were effected.

Figure 4:
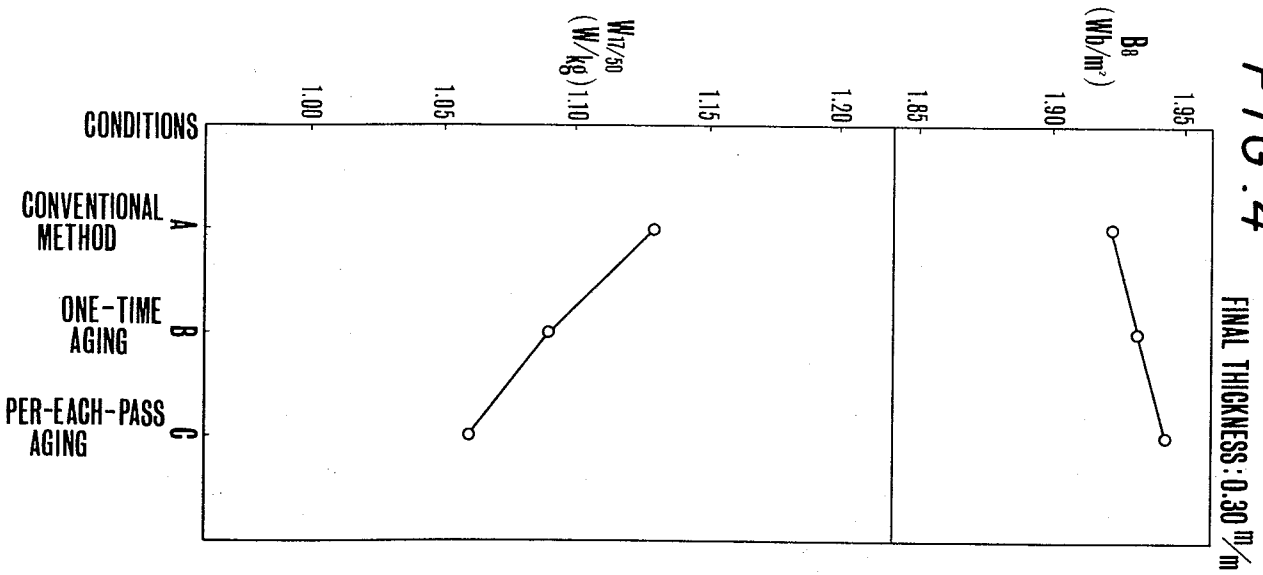
FIG. 4 is a graph showing the magnetic properties of the steel product obtained by Example 4.

The magnetic properties of the products are shown in FIG. 4. It is clear from the figure that the properties of the products are more remarkably improved when the combination of the rolling and the aging is repeated.

What is claimed is:

1. In a cold rolling method for producing a high magnetic flux density grain oriented electrical steel sheet or strip comprising the steps of hot rolling a silicon steel material containing 2.5 to 4.0% Si, not more than 0.085% carbon and 0.010 to 0.065% acid soluble Al, annealing the hot rolled steel sheet at a temperature between 950° and 1200°C and rapidly cooling the steel sheet to precipitate AlN, subjecting the steel sheet to a one-step heavy cold rolling at a reduction rate between 81 and 95 percent to obtain a final sheet thickness, decarburization annealing of the cold rolled steel sheet, and final annealing, the improvement which comprises obtaining the final steel sheet or strip thickness by a plurality of rolling passes of the heavy cold rolling through various interim sheet thicknesses and holding the steel sheet at a temperature between 100° and 350°C for at least 1 minute during the heavy cold rolling step at least one time between the above plurality of rolling passes.

* * * * *